US008960207B2

(12) United States Patent
Mitchell

(10) Patent No.: US 8,960,207 B2
(45) Date of Patent: Feb. 24, 2015

(54) AQUEOUS WASHER WITH ROTATING ARMS WITH NOZZLES

(75) Inventor: Jeffrey C. Mitchell, East Troy, WI (US)

(73) Assignee: LAX Engineered Solutions LLC, Waukesha, WI (US)

( * ) Notice: Subject to any disclaimer, the term of this patent is extended or adjusted under 35 U.S.C. 154(b) by 781 days.

(21) Appl. No.: 13/190,668

(22) Filed: Jul. 26, 2011

(65) Prior Publication Data

US 2013/0025639 A1 Jan. 31, 2013

(51) Int. Cl.
*B08B 3/02* (2006.01)

(52) U.S. Cl.
CPC ..... *B08B 3/02* (2013.01)
USPC ..... 134/172; 134/111; 134/144

(58) Field of Classification Search
CPC ..... B08B 3/02
USPC ..... 134/111, 144, 172
See application file for complete search history.

(56) References Cited

U.S. PATENT DOCUMENTS

| | | | | | |
|---|---|---|---|---|---|
| 2,621,666 | A * | 12/1952 | Ornas | 134/57 R |
| 3,054,411 | A * | 9/1962 | Randall | 134/111 |
| 5,133,375 | A * | 7/1992 | Schinzing et al. | 134/123 |
| 5,494,062 | A * | 2/1996 | Springer | 134/58 D |
| 5,546,969 | A * | 8/1996 | Vilen | 134/188 |
| 2005/0109378 | A1 * | 5/2005 | Landsiedel et al. | 134/135 |
| 2006/0201537 | A1 * | 9/2006 | Strothoff et al. | 134/42 |
| 2010/0139719 | A1 * | 6/2010 | Gnadinger et al. | 134/56 D |

* cited by examiner

*Primary Examiner* — Michael Barr
*Assistant Examiner* — Benjamin L Osterhout
(74) *Attorney, Agent, or Firm* — James Earl Lowe, Jr.

(57) ABSTRACT

A washer adapted to wash a part with a solution, the washer comprising spaced apart sidewalls, and at least one arm rotatably mounted near its center on at least one of the sidewalls. The arm has one end and another end, a central portion, and an angled portion near the one arm end and angled relative to its adjacent arm central portion. The washer also includes a plurality of nozzles spaced apart along the arm central portion and the arm angled portion between near the one arm end and near the other arm end.

11 Claims, 8 Drawing Sheets

IMPINGEMENT PATTERN FOR STANDARD WASHER DESIGN

IMPINGEMENT PATTERN FOR ROTATING NOZZLE SYSTEM

AQUEOUS WASHER WITH ROTATING ARMS WITH NOZZLES

BACKGROUND

This disclosure is directed to an aqueous washer, and, more particularly, to the mechanism used to apply the washer solution to the part to be treated.

Conventional aqueous washers repeatedly apply a solution to a part for some treatment of the part. The conventional aqueous washer comprises a washer housing including spaced apart sidewalls, and a top wall connecting the sidewalls. Fixedly attached to each of the sidewalls are spaced apart rows of risers, each riser including a plurality of spaced apart nozzles. Each riser is intended to treat the part as the part moves past the riser. The riser nozzles direct the solution onto the part placed within the housing. In other instances, an operator may use a portable wand, with a nozzle on the end, in order to spray the part. The risers can be of various shapes, from straight, to curved. And some risers have straight central portions, and angled end portions.

SUMMARY

It is an object of this disclosure to provide an improved aqueous washer that accomplishes a better result than conventional washers, while only using a fraction of the amount of aqueous solution and energy.

This disclosure thus provides a washer adapted to wash a part with a solution, the washer comprising spaced apart sidewalls, and at least one arm rotatably mounted near its center on at least one of the sidewalls. The arm has one end and another end, a central portion, and an angled portion near the one arm end and angled relative to its adjacent arm central portion. The washer also includes a plurality of nozzles spaced apart along the arm central portion and the arm angled portion between near the one arm end and near the other arm end.

In one embodiment, the washer arm has another angled portion near the other arm end and angled relative to its adjacent arm central portion. Further, the central portion and the angled portions are straight.

This disclosure also provides a washer comprising a housing including spaced apart sidewalls, a floor, and a top wall connecting the sidewalls and spaced apart from the floor. The washer also includes at least one arm rotatably mounted near its center on one of the sidewalls. The arm has one end and another end. Another arm is rotatably mounted near its center opposite the one arm and on the other sidewall. A plurality of nozzles are spaced apart along the arm between near the one arm end and near the other arm end, the arm having a sufficient length so that the one arm end is near the housing top wall and the other arm end is near the floor.

Figure 1:
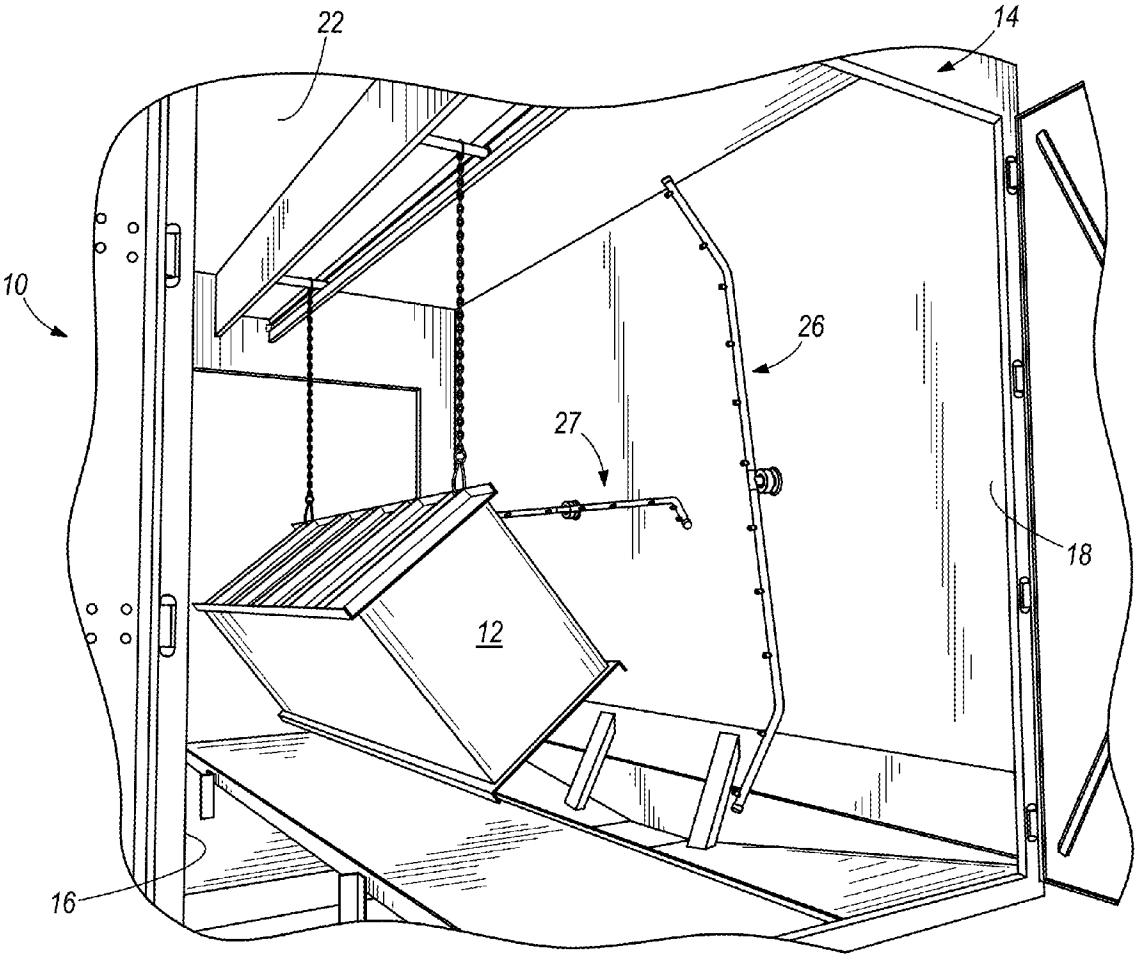
FIG. 1 is a perspective view of part of the inside of an aqueous washer according to this disclosure.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward", "downward", "side", "top" and "bottom", etc., are words of convenience and are not to be construed as limiting terms.

DESCRIPTION OF THE PREFERRED EMBODIMENT

As illustrated in the drawings, an aqueous washer 10 according to this disclosure treats a part 12 with aqueous solution. The washer 10 includes a washer housing 14 including spaced apart sidewalls 16 and 18, and a top wall 22 connecting the sidewalls 16 and 18. Attached to each of the sidewalls is a rotating arm 26. A sidewall, as used herein, is a structure adapted to support the rotating arm. In some embodiments (not shown), the sidewall may be just a post either hanging from a ceiling or mounted on a floor, for example. In still other embodiments (not shown), the sidewalls may be freestanding, and not part of a washer housing. In still other embodiments (not shown), the sidewall may be horizontal, with the arm spraying downward onto a part.

Arm, as used herein, means an elongated element allowing a solution, such as water mixed with a cleaner, acid, or other chemical, to pass through the element, the element having a plurality of spaced apart openings 34 (see FIG. 2) in communication with the solution within the element. More particularly, the washer apparatus 10 also includes a plurality of spaced apart nozzles 40 secured, in a conventional manner, within the openings 34. The arm 26 is attached at its center to its respective sidewall by a rotary union or hub assembly 44.

More particularly, each arm is in the form, in the preferred embodiment, of a stainless steel pipe having a straight central portion 50, a first angled portion 54 attached to one end of the central portion 50, and a second angled portion 58 attached to the other end of the central portion 50. In other embodiments, the arm can be made of plastic, steel, or other materials. Each angled portion is in the form of a straight steel pipe. In other embodiments (not shown), other central portion and angled portion pipe shapes can be used. In the preferred embodiment, the angle defined between the central portion and each angle portion is about 135°. In other embodiments, other obtuse angles can be used. In still other embodiments (not shown), other arm shapes can be used, such as that of a flattened C-shape.

Figure 2:
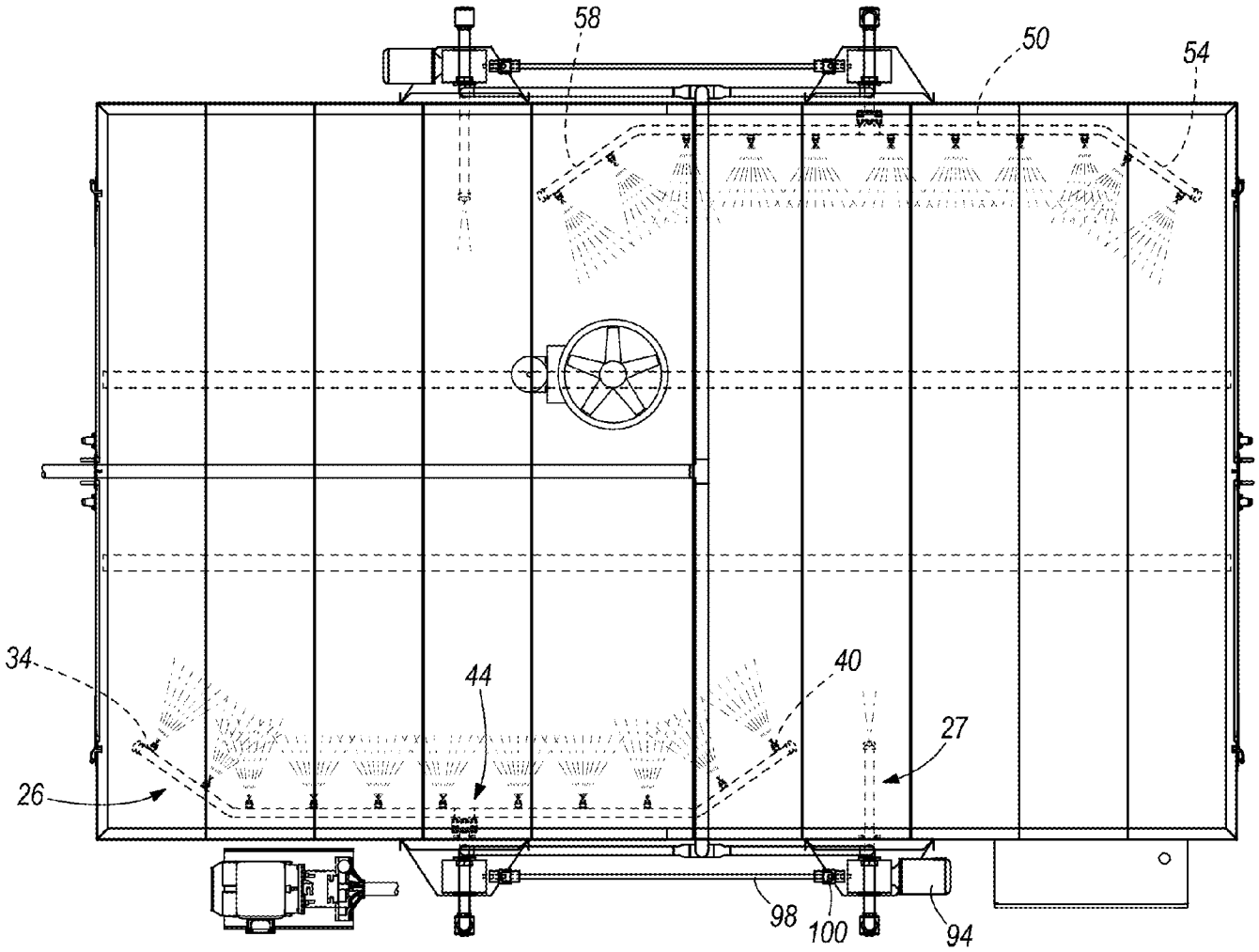
FIG. 2 is a top view, partially in ghost, of the aqueous washer shown in FIG. 1.

In the simplest embodiment of the aqueous washer 10, a single arm 26 is mounted on just one of the sidewalls. In a more typical aqueous washer, as shown in FIG. 2, an arm 26 is attached to one sidewall, and another arm 26 is attached to the other sidewall, opposite the first arm, as also shown in FIGS. 1 through 5. When longer parts need to be exposed to aqueous solution, attached to each sidewall are arms 26 and 27, as shown in FIG. 2, spaced apart in the horizontal direction. One arm 26 is mounted to rotate 90° out of phase with the rotation of its adjacent arm 27, as shown in FIG. 4.

Figure 8B:
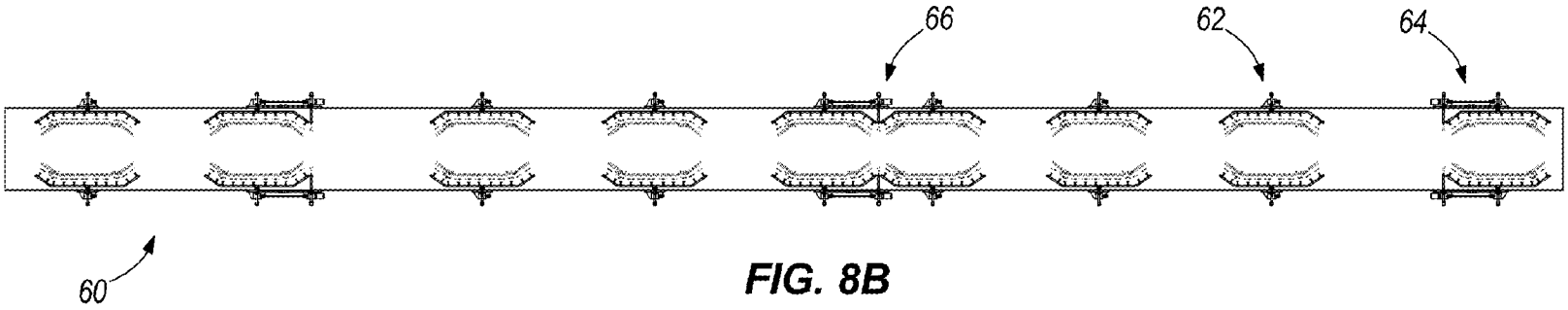
FIG. 8B is a schematic top view of the washer system shown in FIG. 8A.
Figure 8A:
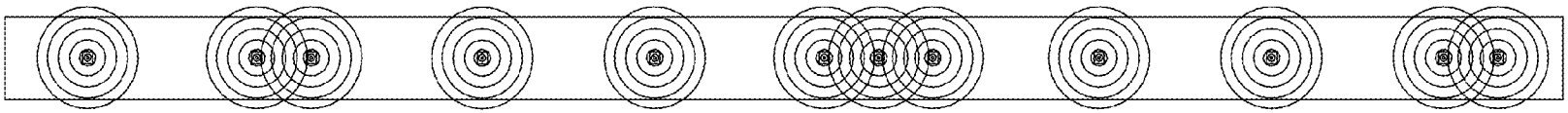
FIG. 8A is a schematic side view of the washer system including a number of spaced apart washers.

In other aqueous washers, additional arms, 90° out of phase with its respective adjacent arm, can be used. For example, in the washer system 60 shown in FIG. 8, the washer system 60 includes a plurality of adjacent washers, designed to take a part from one washer 64 and then feed it to the next washer 62. Each washer applies a different aqueous solution to the part 12. Some washers 62 include a single arm on each wall, while others 64 include a pair of arms on each wall, while still others 66 include three spaced apart arms on each wall.

Figure 7:
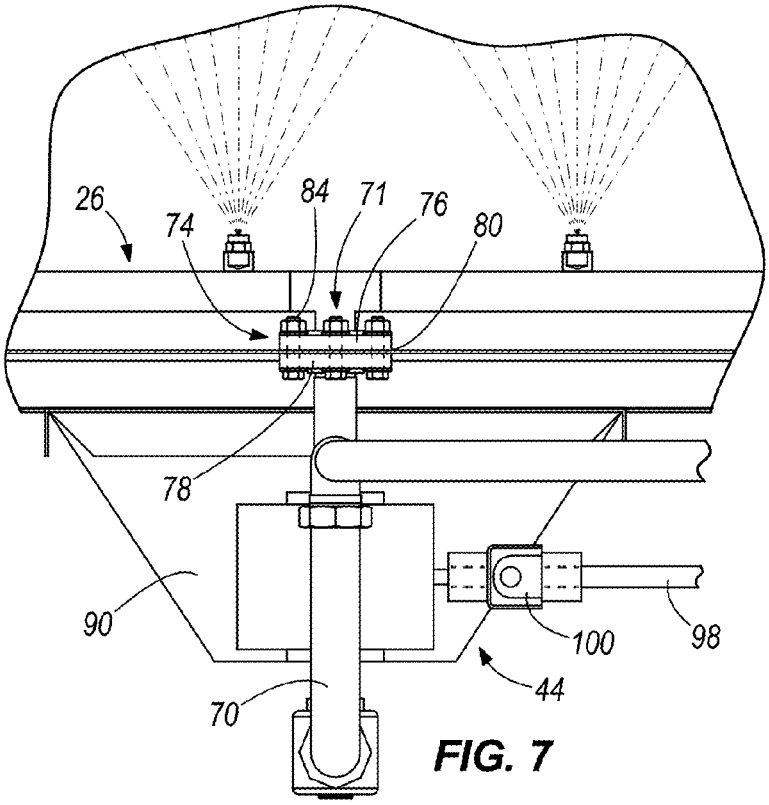
FIG. 7 is a cross-sectional view of the hub shown in FIG. 6.

As illustrated in the drawings, and most particularly in FIG. 7, the aqueous solution enters the arm 26 via the hub assembly 44. The hub assembly 44 includes a fluid inlet pipe 70 in fluid communication with an opening 71 into the arm 26. The arm 26 is attached to the inlet pipe 70 by a bracket assembly 74 comprising a flanged inlet 76 defining the opening 71 to the arm 26, and a flanged outlet 78 from the inlet pipe 70, a seal 80 between the flanges of the inlet 76 and the outlet 78, and a plurality of nut and bolt assemblies 84 that passes through openings in the flanges. Another seal (not shown) surrounds the inlet pipe 70 where it passes through the sidewall 16.

In order to rotate the arm 26 relative to its respective wall, the hub assembly 44 further includes a conventional gearbox 90 that surrounds, and drivingly engages to rotate, the inlet pipe 70. The gearbox 90 is driven either by an electric motor 94 (see FIG. 2), or by a transfer shaft 98 that extends between one gearbox, and an adjacent gearbox, and is driven by the adjacent gearbox and its respective electric motor. The ends of the transfer shaft are attached to the respective gearboxes by universal joints 100.

Figure 3:
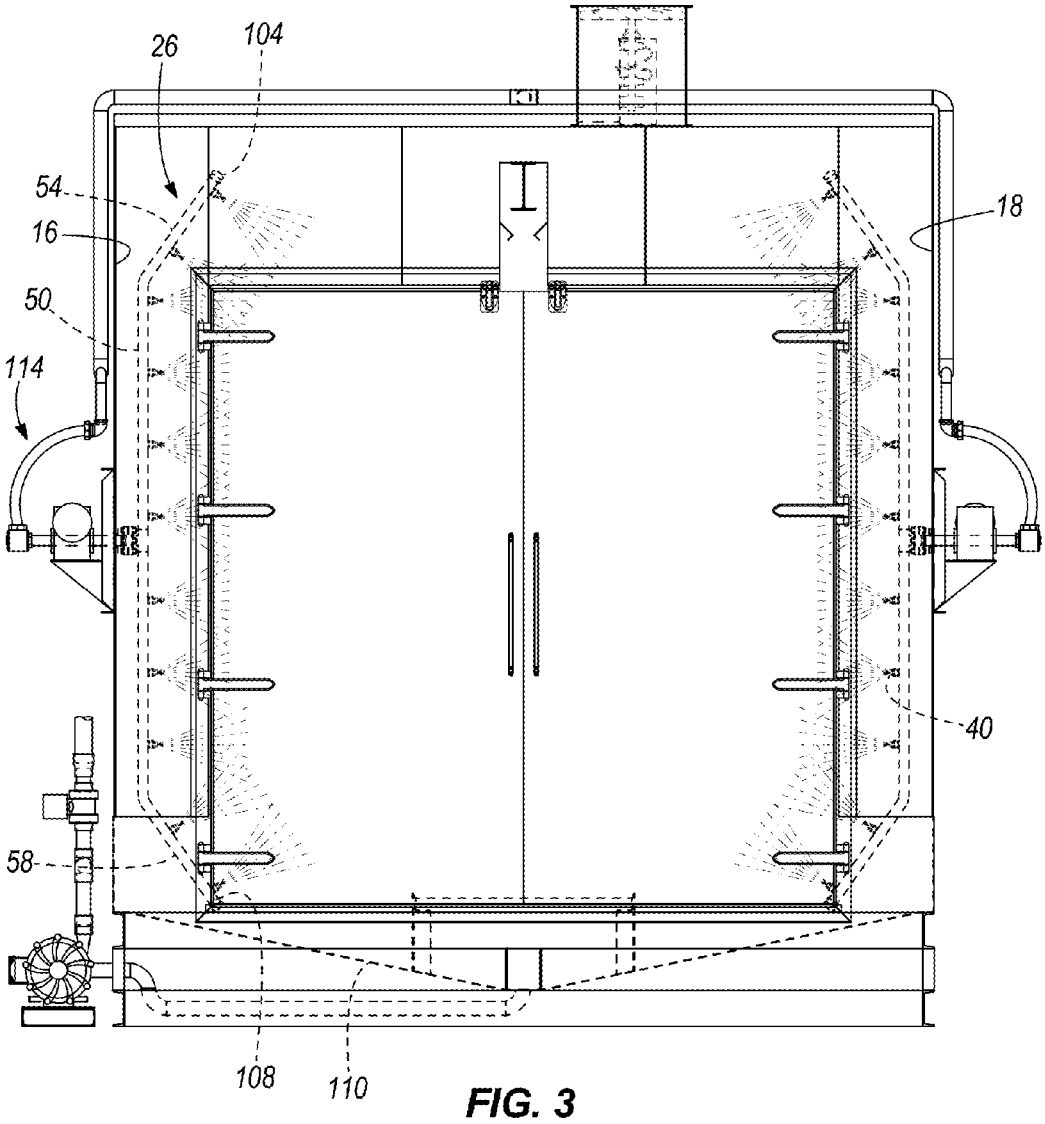
FIG. 3 is an end view, partially in ghost, of the aqueous washer shown in FIG. 1.
Figure 4:
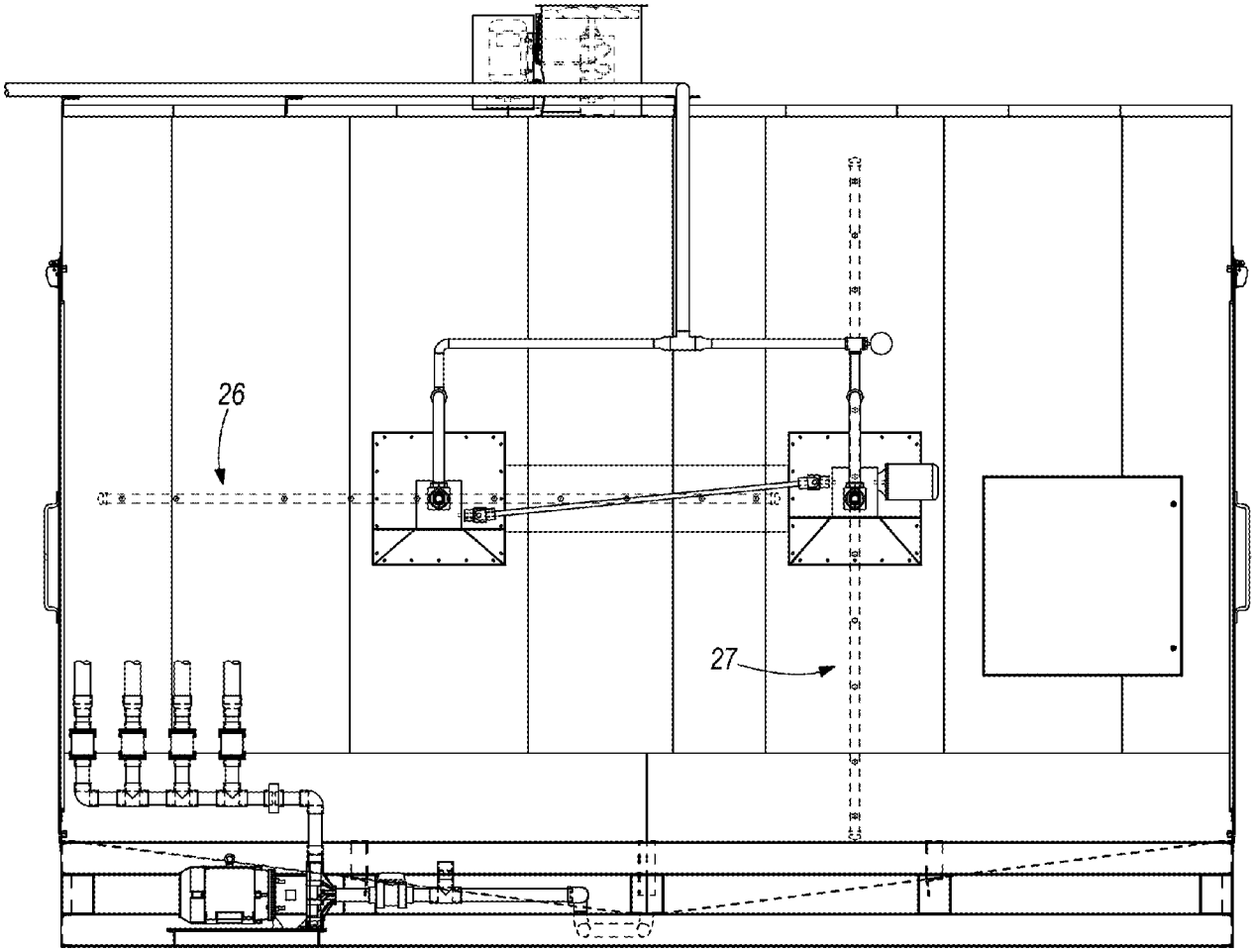
FIG. 4 is a side view, partially in ghost, of the aqueous washer shown in FIG. 1.
Figure 5:
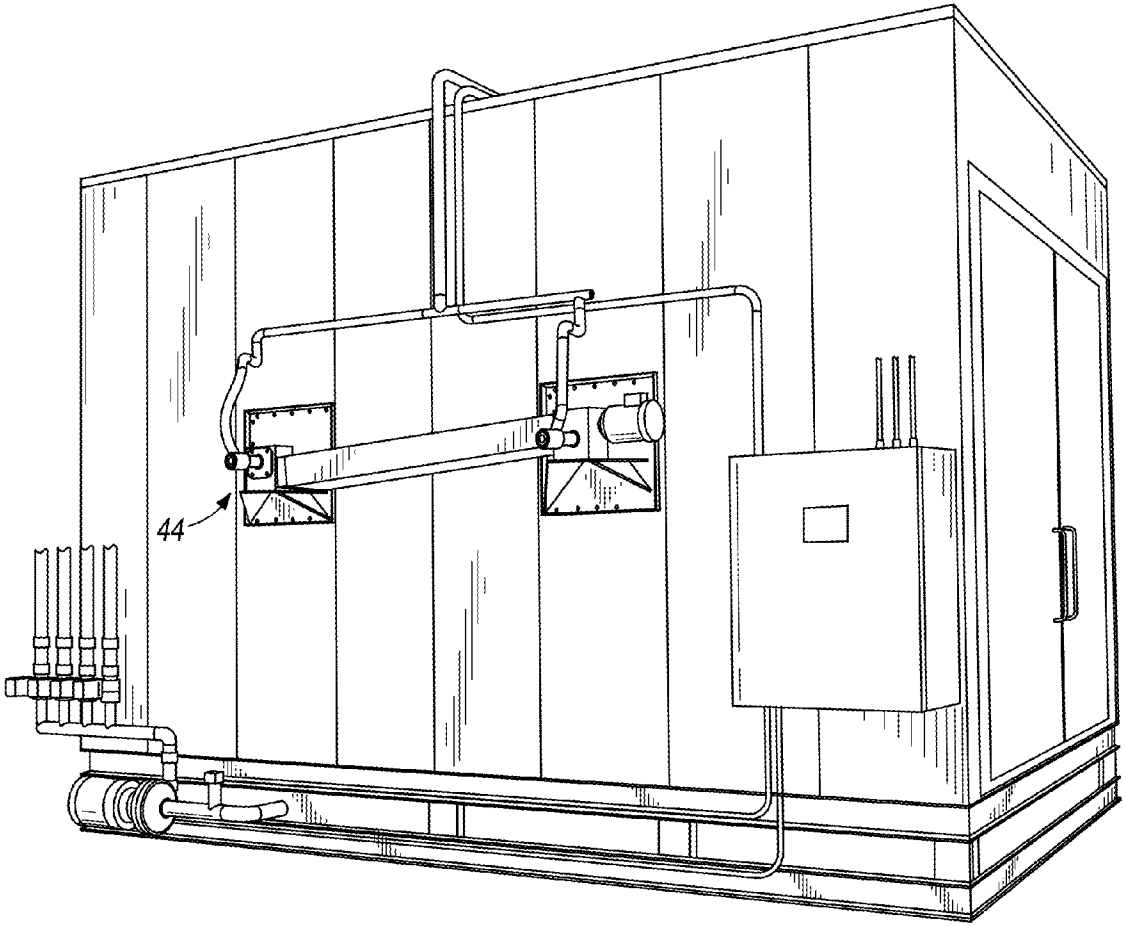
FIG. 5 is a perspective view of the side of the aqueous washer shown in FIG. 1.
Figure 6:
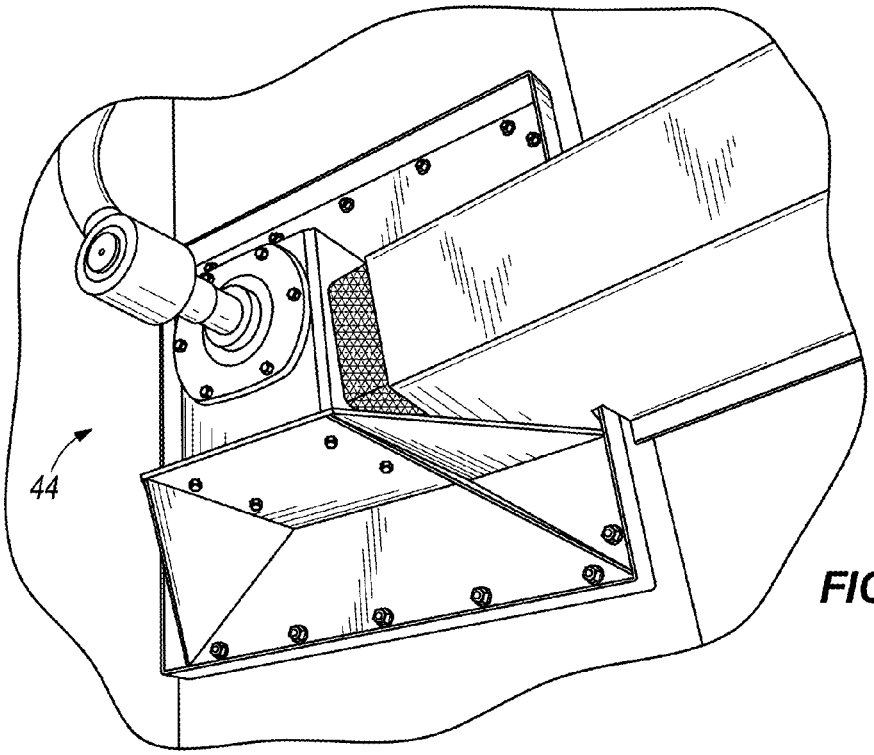
FIG. 6 is an enlarged perspective view of a water connection to the hub of a washer arm.

As shown in FIG. 3, each arm 26 has one end 104 that extends from near the top of the sidewall to which it is attached, and another end 108 near the bottom of the sidewall to which it us attached. As a result, the aqueous solution is sprayed from the arm onto essentially all of the part 12 to be treated by the aqueous solution.

When the arm 26 rotates, it sprays the aqueous solution onto the part 12 in the washer 10. Generally, the arm 26 will rotate through 360 degrees several times while treating the part 12. Each nozzle 40 sprays the part 12 a number of different times, depending on the number of times the arm is rotated. The nozzles 40 on the angled portions 54 and 58 of the arm 26 spray the part at an angle other than normal to the part 12. This encourages the aqueous solution to enter into any cavities within the part 12, while also spraying the ends and top of the part.

In addition, since the spray from the angle portions is directed more towards the center of the arm 26, less cross contamination occurs of the spray from one washer to an adjacent washer. Cross-contamination occurs in some conventional systems (not shown) where spraying from one washer assembly enters into the spray area of an adjacent but different washer assembly. And in some conventional systems (not shown), a plurality of nozzles need to be mounted on a top wall of the washer housing, in order to spray the top of the part. The arm angled portions help to direct spray onto the top of the part, thereby eliminating the need for nozzles on the top wall of the housing.

The washer housing 14 also includes, as shown in FIG. 3, a V-shaped floor 110. The V-shaped floor 110 encourages the aqueous solution runoff to gather in the central portion of the floor, where it can then be pumped back into aqueous solution storage. The washer 10 also concludes appropriate piping 114 for providing aqueous solution to the arms 26, and for removing aqueous solution from the washer housing 14.

Figure 9B:
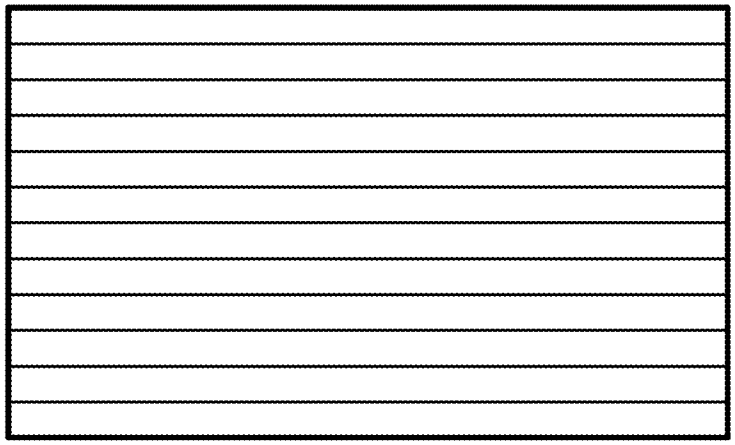
FIG. 9B is a graphical illustration of the direct impingement pattern of aqueous solution applied to a part by the washer of this disclosure.
Figure 9A:
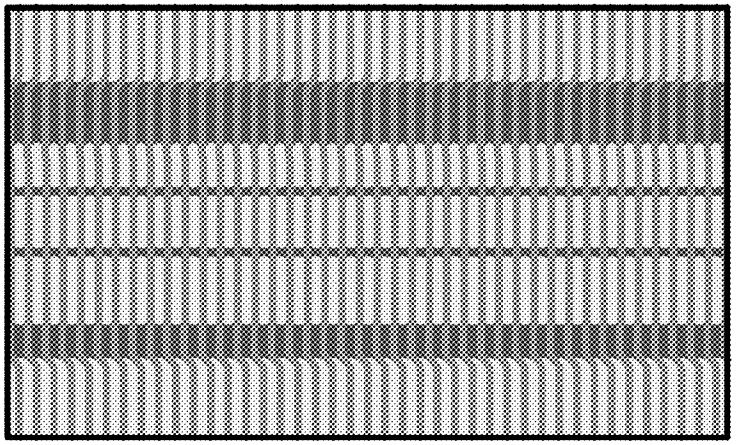
FIG. 9A is a graphical illustration of the direct impingement pattern of aqueous solution applied by a conventional washer.

As illustrated in FIG. 9A, in a washer system where the part moves through the washer, the direct impingement pattern of the washer 10 according to this disclosure covers more of the part being washed then in conventional systems, as shown in FIG. 9B. The result is that a substantially lower amount of aqueous solution is needed in order to cover the part with aqueous solution. In an eight stage washing system, such as that shown in FIG. 8, less than 20 percent is needed of the solution used in a conventional system. And not only is less aqueous solution needed, but also less evaporation occurs, reducing the amount of evaporated solution that needs to be kept out of the environment. Further, since less solution needs to be pumped, significant savings in electrical use is also possible.

In the illustrated embodiment, the part 12 is stationary within the washer housing 14. In other embodiments, such as in the washer system shown in FIG. 8, a conveyor system (not shown) can be used to support the part within the washer system, and to move the part through the washer system.

Various other features of this disclosure are set forth in the following claims.

The invention claimed is:

1. A washer adapted to wash a part with a solution, the washer comprising: spaced apart sidewalls, a housing including said sidewalls, a floor, and a top wall connecting said sidewalls and spaced apart from said floor, at least one arm rotatably mounted on at least one of said sidewalls, said arm having one end and a plurality of nozzles spaced apart along said arm, the nozzles near the arm end being angled back toward the rest of the arm and angled toward the opposite sidewall.

2. A washer in accordance with claim 1 wherein said arm has one end and another end and is rotatably mounted hear its center, and has a sufficient length so that, at times, said one arm end is near said housing top wall and said other arm end is near said floor.

3. A washer in accordance with claim 2 wherein said arm has a central portion that is straight.

4. A washer in accordance with claim 2 wherein said arm has-nozzles near the other arm end angled back toward the rest of the arm.

5. A washer in accordance with claim 2 wherein the nozzles are angled back toward the rest of the arm by being mounted on an angled portion of the arm near the one arm end.

6. A washer in accordance with claim 5 wherein each of said arm ends has straight angled portions.

7. A washer in accordance with claim 6 wherein the angle between each of said angled portions and an adjacent arm central portion is about 135 degrees.

8. A washer in accordance with claim 1 and further including means for rotating each of said arms.

9. A washer in accordance with claim 1 wherein said arm has one end and the arm has a sufficient length so that, at times, said one arm end is near said housing top wall and said one arm end is near said floor.

10. A washer in accordance with claim 1 and further including another arm rotatably mounted opposite the one arm and on the other sidewall, said arm having one end and a plurality of nozzles spaced apart along said arm, the nozzles near the arm end being angled back toward the rest of the arm.

11. A washer system including a plurality of spaced apart washers, each washer adapted to wash a part with a solution and including: spaced apart sidewalls, a housing including said sidewalls, a floor, and a top wall connecting said sidewalls and spaced apart from said floor, at least one arm rotatably mounted near its center on at least one of said sidewalls, said arm having one end and another end, a central portion, and an angled portion near said one arm end and angled relative to its adjacent arm central portion, a plurality of nozzles spaced apart along said arm central portion and said arm angled portion between near said one arm end and near said other arm end and angled toward the opposite sidewall.

* * * * *